United States Patent [19]

Weisert et al.

[11] Patent Number: 4,717,433

[45] Date of Patent: Jan. 5, 1988

[54] METHOD OF COOLING A HEATED WORKPIECE UTILIZING A FLUIDIZED BED

[75] Inventors: Edward D. Weisert, San Carlos; David W. Schulz, Belmont, both of Calif.

[73] Assignee: Rockwell International Corporation, El Segundo, Calif.

[21] Appl. No.: 472,911

[22] Filed: Mar. 7, 1983

[51] Int. Cl.[4] ..... C21D 1/53

[52] U.S. Cl. ..... 148/20.3; 148/131; 148/158

[58] Field of Search ..... 148/16, 16.5, 16.7, 148/20.3, 131, 158, 130, 162, 138; 432/15, 28

[56] References Cited

U.S. PATENT DOCUMENTS

| | | | |
|---|---|---|---|
| 3,048,383 | 8/1962 | Champlin | 266/5 |
| 3,053,704 | 9/1962 | Munday | 148/20.3 |
| 3,197,328 | 7/1965 | Jung et al. | 117/107.2 |
| 3,197,346 | 7/1965 | Munday | 148/13 |
| 3,391,915 | 2/1964 | Morgan | 266/3 |
| 3,397,873 | 11/1964 | Ritchie et al. | 263/21 |
| 3,658,602 | 4/1972 | Pomey | 148/14 |
| 3,666,253 | 5/1972 | Yosio et al. | 266/5 E |
| 4,410,373 | 10/1983 | Kemp | 148/16 |

FOREIGN PATENT DOCUMENTS

| | | | |
|---|---|---|---|
| 2448573 | 10/1980 | France | 266/252 |

OTHER PUBLICATIONS

Metals Handbook, Eighth Edition, vol. 2, pp. 301-306.

*Primary Examiner*—Christopher W. Brody
*Attorney, Agent, or Firm*—Charles T. Silberberg

[57] ABSTRACT

A fluidized bed of solid particulate material cools a heated workpiece through a temperature range critical to strength property determination. Upon immersion into the fluidized bed container the bed is allowed to collapse around the workpiece forming a universal fixture which firmly supports the workpiece for the remainder of the cooling, allowing cooling to be completed at a slower rate to prevent or minimize distortion caused from differential thermal contractions.

10 Claims, 1 Drawing Figure

30
28

26
12
10
24
22
20
16
16
IN
14
18

METHOD OF COOLING A HEATED WORKPIECE UTILIZING A FLUIDIZED BED

BACKGROUND OF THE INVENTION

The present invention relates generally to a novel method of processing a heated workpiece utilizing a fluidized bed, which acts as both a cooling media and a universal fixture.

In superplastic forming, a process finding increased acceptance in the aircraft industry, a sheet metal blank having superplastic characteristics is formed to complex shapes with precise tolerance at elevated temperatures (in the range of 1500°-1750° F. for titanium alloys) and under pressure conditions, where the blank exhibits superplastic properties. The metals used are preferably titanium, aluminum, and the alloys of each. When the blank has completely formed, the part must be cooled in such a uniform manner so as to maintain tolerances and avoid distortion. (See U.S. Pat. No. 4,233,831.) This cannot be accomplished with conventional quenching media, such as water, brine, or a salt bath.

Diffusion bonding is a process where similar metallic parts are pressed together at elevated temperatures and pressures causing deformation which results in initimate contact of the surfaces to be joined and subsequent diffusion of the atomic structure, thereby forming a monolithic metallic piece with joint strength equivalent to that of the parent metal. The metals used in diffusion bonding are titanium alloys which are susceptable of superplastic forming. For certain applications diffusion bonding can be used in conjunction with superplastic forming, or the two forming processes can be used independently of each other since both processes occur at elevated temperatures. These structures must be cooled from these elevated temperatures without warpage. The most common alloy used in superplastic forming/diffusion bonding is Ti-6A1-4V.

Normally structures fabricated from titanium alloy sheet are not heat treated to higher than recrystallized annealed temperatures, since the severe quench cooling rate required creates a severe distortion problem. Similarly, products formed from aluminum alloy sheets require fixturing to survive the quench rates imposed during strengthening heat treatments. Fixture tooling can be expensive and generally will be specific to a given configuration. For titanium alloy sheet structure the high temperatures involved preclude the use of water quenching.

Fluidization of particulate, solid matter is well known, and is currently used in many process industries. Conventionally, a fluid under pressure is passed through a porous diffuser and introduced into a bed of finely divided solid, particulate material. The flow rate of the pressurized fluid is sufficient to levitate and agitate the solid particles thereby imparting fluid characteristics to the bed.

A high rate of heat transfer is possible when a workpiece is immersed in the fluidized bed and there is a substantial temperature differential between the workpiece and the bed. This is caused by the turbulent motion, rapid circulation rate of the particles, and the large amount of surface area per unit volume of the solid particulate material. Even though the heat transfer coefficients for a particulate material are not usually high, the amount of surface area per unit volume is large: for ordinary sand, the surface area to bulk range is from 1000 to 5000 $ft^2/ft^3$. The heat transfer coefficient of a fluidized bed is usually between 20 and 210 $Btu/ft^2 \cdot hr \cdot °F.$, which is comparable to salt or lead bath equipment. The primary advantage of the fluidized bed approach is that the process remains essentially isothermal. Other advantages include an easily varied contact time, and an apparatus that can be reused and is readily adaptable to continuous, automatic operations.

A new cooling method is required so that heated workpieces of complex shapes involving sheet metal fabrication may be cooled at a uniform and controlled rate, so that metal strength properties can be optimized while minimizing distortion.

SUMMARY

The primary object of the invention is to provide a method for cooling a workpiece from process temperature to ambient in a manner that will minimize distortion caused by non-uniform thermal contraction. Although the use to date of the invention has been limited to metallic workpieces, the invention is also applicable to nonmetallic objects where the finished product must be of high precision with minimal distortion and loss of strength resulting from differential thermal contraction.

Another object is to provide a quenching media allowing for developing improved strength, but without the distortion encountered in a water quench.

Another object of the invention is to provide a cooling method for a metallic workpiece that is controllable and reproducible.

Another object of the invention is to provide a cooling method wherein a hot metal workpiece is immersed in a body of finely divided solid particle material within a confined treating region.

Another object of the invention is to provide a cooling method which involves an apparatus of simple construction, that is economical to manufacture and commercially available.

The invention involves the use of a conventional fluidized bed to rapidly cool a workpiece to below its critical temperature range, i.e. where a slower rate of cooling will not result in transformation, and then using the fluidized bed as a holding fixture as the remaining cooling occurs more slowly at a controlled and uniform rate to prevent or minimize distortion, warpage, and buckling caused by differential thermal contraction. Initially, the fluidized bed container is nearly filled with a solid particulate material preferably alumina. Other possible materials include sand, (silica) or metal powders (such as copper). The container has a fluid inlet at the bottom so that a fluid, preferably a gas such as air, or some inert gas such as nitrogen, is diffused upward through the solid particulate material at a controlled rate, thereby generating the fluidized state of the particulate bed. The use of an inert gas has the added advantage of protecting the workpiece from oxidation during the cooling cycle although this may not be necessary for rapid quenching. The state of fluidization (smooth, bubbling, slugging, or lean) can be controlled by the flow rate of the fluid through the container. A smooth to barely bubbling state of fluidization is preferred.

The heated workpiece is rapidly transferred to and immersed in the fluidized bed, whereupon the fluid pressure is immediately and abruptly decreased, and preferably shut off, allowing the solid particulate material to collapse around the workpiece, thereby substantially supporting the embedded workpiece and acting as a universal fixture.

The bed serves as a cooling and holding fixture. During immersion the workpiece is rapidly cooled through the critical temperature range (temperatures encompassing the "knee" of the transformation curve) for the particular material, at a rate which is critical (by avoiding substantial transformation) to achieving improved strength in subsequent aging treatments. The cooling rate achieved is comparable to a water quench, whereas the uniformity of the cooling eliminates or minimizes distortion as the temperature of the workpiece cools through the critical temperature range. By then, the bed has collapsed and the cooling is completed at a slower rate which minimizes workpiece distortion.

After the cooling of the workpiece is completed, it is removed from the fluidized bed container. The workpiece can then be age hardened to improve strength properties. This is particularly important when the workpiece is a sheet metal structure of one or more sheets subject to distortion by water quenching and transformation if slowly cooled through the critical temperature range, i.e. transformation would preclude strength enhancement by age hardening. The temperature of the particulate material is reduced to an acceptable level by refluidizing the bed, whereby it is then ready to receive the next workpiece.

Other objects and advantages of the invention will become apparent upon reading the following detailed description and upon reference to the drawing.

Figure 1:
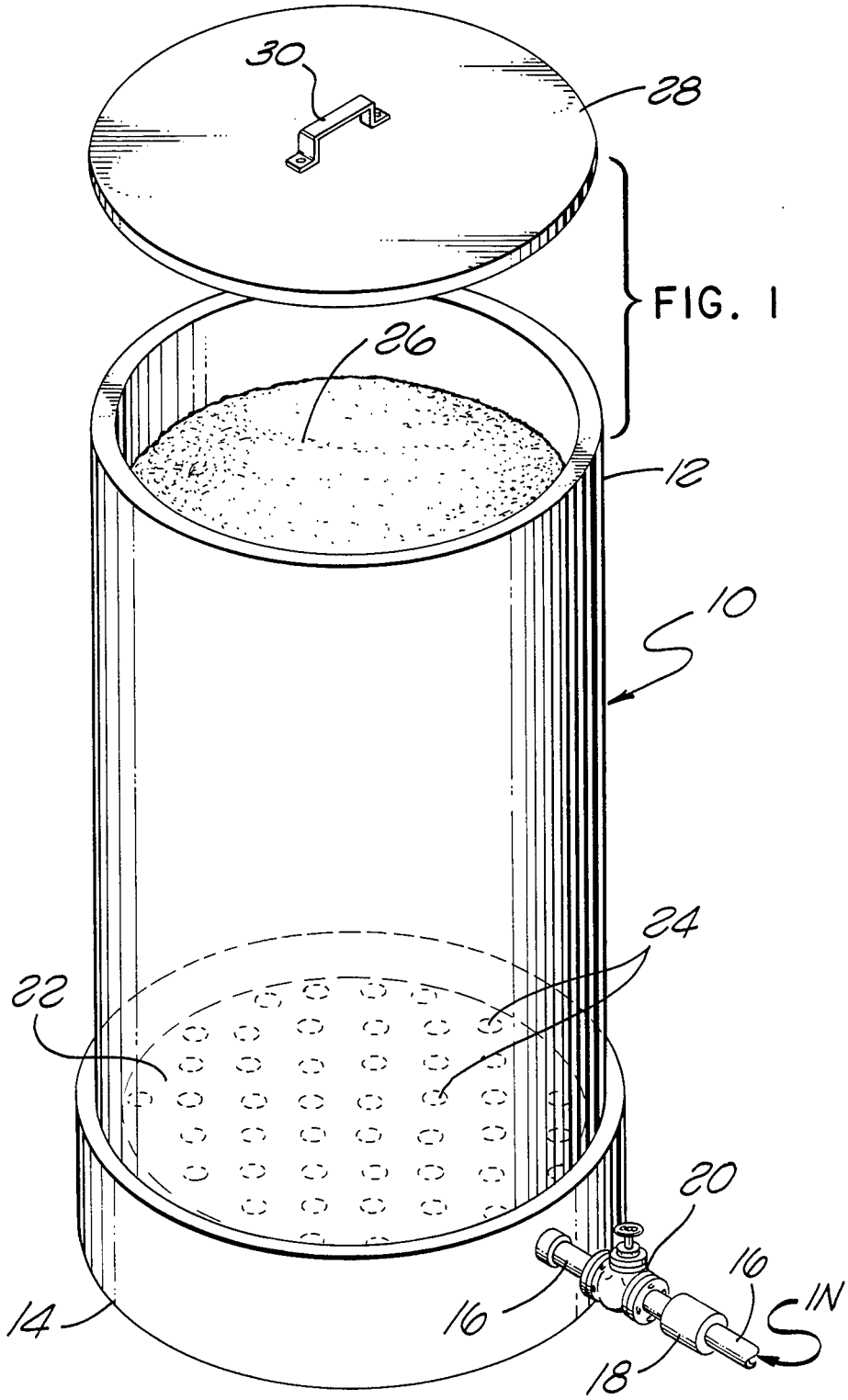
FIG. 1 is an isometric view of the preferred embodiment of the holding and cooling fixture used to practice the method of the subject invention.

While the invention will be described in connection with the preferred embodiments, it is not intended to limit the invention to those embodiments. Accordingly, it should be clearly understood that the form of the present invention described herein is illustrative only and is not intended to limit the scope of the invention.

DETAILED DESCRIPTION OF THE INVENTION

Referring now to FIG. 1 there is shown the holding and cooling fixture generally indicated at 10 which is used in the subject invention; the fixture 10 can be purchased from the Procedyne Corporation of New Brunswick, N.J. and is a Model AB-3048. The shape and size of the fixture 10 is largely dependent on the geometry of the workpiece (not shown) although a 35 to 55 gallon container has been used in trial runs. The container wall 12 is cylindrical having a 30-inch diameter and is 48 inches deep. The fixture 10 is mounted on a hollow support base 14, through which the fluid supply inlet 16 is mounted. The fluid supply is rated at 24 SCFM at a pressure exceeding 20 PSIG. The solid particulate material 26 is in the order of 150 mesh and is preferably alumina, although copper or silica can also be used. Particulate size is critical, since heat transfer improves with smaller particles, because of the increased surface area. However if the particulates are too fine, dusting occurs. The particulate material should exhibit good heat sink properties so as to absorb heat rapidly from the workpiece. The material should be relatively inert when in contact with the surface of the workpiece, altough this may not be critical since the cooling rate is so rapid. The container wall 12 is filled to within about 6 inches of the container top. The fluid supply inlet 16 contains a fluid regulator 18 to regulate and monitor the fluid flow, and an automatic fluid shut-off valve 20 (open-close).

The cooling fixture 10 is also equipped with a water circulating system (not shown) within the container wall 12 which may be used to control the initial bed temperature by aiding heat removal subsequent to use.

Mounted within the cooling fixture 10, on the support base 14 is a base plate 22 containing a multiplicity of holes 24, which are substantially evenly distributed throughout the base plate 22. The holes 24 are each filled and anchored with screws (not shown) which may be adjusted and loosened to insure uniform fluid flow within the cooling fixture 10 which is also equipped with a lid 28, having a lid handle 30 that can be used to seal the container during cooling and nonuse.

The cooling and holding fixture 10 is placed as close to the work area as is practical. In superplastic forming, a formed workpiece, i.e. of Ti-6A1-4V, is removed from the forming apparatus which is located adjacent to the cooling fixture 10, the workpiece being heated in the broad range of 1500°–1750° F. although 1600° F. is preferred. The container 12 holding the solid particulate material 26 is a fluidized bed since the fluid is being circulated within the container 12. A tool (not shown) is used to remove the heated workpiece from the press quickly. The workpiece may be covered during removal from the forming apparatus with insulation to prevent cooling into the critical temperature range, at too slow a rate before it is inserted into the fluidized bed. As soon as the heated workpiece is fully immersed within the bed (preferably no more than 10 [ten] seconds after removal from the press) the air pressure is decreased, preferably shut off, and the mechanism that transfers the workpiece from the press to the container releases the workpiece. Preferably, such pressure decrease does not occur until after the workpiece temperature is below its critical temperature range, i.e. approximately 1000° to 1500° F. for Ti-6-A1-4V.

Rapid removal and rapid quench are essential to obtain improved material properties. Hence the critical cooling occurs while the part is immersed and for the time before the bed is collapsed. The collapsing solid particulate material will substantially support the weight of the workpiece. Once the bed is collapsed, the cooling of the workpiece occurs at a much slower rate. The workpiece remains within the container until it is significantly below the critical temperature range for the material being quenched. The workpiece is then removed and the gas source is turned on to refluidize the bed, so that the fluidized bed may be used to cool another workpiece. Distortion is avoided before collapse by the uniformity of the heat transfer and after collapse by the fixturing action of the particulate bed. Subsequently the formed workpiece can be age hardened to improve strength properties.

Accordingly, there has been provided, in accordance with the invention, a method of cooling a heated workpiece that fully satisfies the objectives and advantages set forth above. It is understood that all terms used herein are descriptive rather than limiting. While the invention has been described in conjunction with specific embodiments, it is evident that many alternatives, modifications, and variations will be apparent to those skilled in the art in light of the disclosure herein. Accordingly, it is intended to include all such alternatives, modifications, and variations that fall within the spirit and scope of the appended claims.

We claim:

1. A method of cooling a heated workpiece, the heated workpiece being at a temperature within or above its critical temperature range, which comprises:

providing a fluidized bed containing a solid particulate material circulated by means of a pressurized fluid, said particulate material being at a temperature substantially below that of the workpiece;

immersing said heated workpiece into said fluidized bed;

cooling said workpiece in said fluidized bed to a temperature below the critical temperature range for the workpiece material such that transformation of the workpiece material is substantially minimized;

decreasing the flow of said pressurized fluid such that said solid particulate material collapses around said workpiece, thereby substantially embedding and supporting said workpiece;

allowing said workpiece to cool while embedded within said particulate material; and removing said workpiece from said particulate material.

2. The method of cooling a workpiece as recited in claim 1, wherein said pressurized fluid is air or an inert gas.

3. The method of cooling a workpiece as recited in claim 1, wherein the flow of said pressurized fluid is decreased so that it is completely shutoff after said heated workpiece is immersed within said solid particulate material.

4. The method of cooling a workpiece as recited in claim 1, wherein said workpiece is at an elevated temperature in the range of 1500° F. to 1750° F., prior to said immersing step.

5. The method of cooling a workpiece as recited in claim 1 wherein said decreasing of said flow occurs within ten seconds after said immersing step.

6. The method of cooling a workpiece as recited in claim 1, further comprising continuously circulating a cooling liquid around said container.

7. The method of claim 1 also including age hardening said workpiece.

8. The method of claim 1, wherein said workpiece is a sheet metal structure.

9. The method of claim 1, wherein said particulate material acts as a universal fixture for said workpiece after said fluid flow is decreased.

10. The method of claim 1, wherein said particulate material is the sole support for said workpiece after said fluid flow is decreased.

* * * * *